US006559396B1

(12) United States Patent
Chou

(10) Patent No.: US 6,559,396 B1
(45) Date of Patent: May 6, 2003

(54) TILT SWITCH

(76) Inventor: Tien-Ming Chou, No. 41, San-Hsi 5th St., Pei Dist., Taichung City (TW)

( * ) Notice: Subject to any disclaimer, the term of this patent is extended or adjusted under 35 U.S.C. 154(b) by 0 days.

(21) Appl. No.: 10/172,227

(22) Filed: Jun. 13, 2002

(51) Int. Cl.[7] ..... H01H 35/02
(52) U.S. Cl. ..... 200/61.52; 200/61.45 R
(58) Field of Search ..... 200/220–223, 200/226, 277, 61.45 R, 52 A, 61.52

(56) References Cited

U.S. PATENT DOCUMENTS

| | | | | | |
|---|---|---|---|---|---|
| 3,812,308 | A | * | 5/1974 | Bell et al. | 200/61.45 R |
| 4,135,067 | A | * | 1/1979 | Bitko | 200/61.52 |
| 4,618,746 | A | * | 10/1986 | Schwob et al. | 200/61.45 R |
| 5,639,999 | A | * | 6/1997 | Hsu | 200/61.52 |
| 5,672,856 | A | * | 9/1997 | Kolb et al. | 200/61.52 |
| 6,005,205 | A | * | 12/1999 | Chou | 200/61.45 M |
| 6,011,254 | A | * | 1/2000 | Sano et al. | 250/231.1 |
| 6,028,275 | A | * | 2/2000 | Jou | 200/61.52 |
| 6,448,516 | B1 | * | 9/2002 | Chiang | 200/61.45 R |

FOREIGN PATENT DOCUMENTS

| | | | |
|---|---|---|---|
| DE | 4021055 | * | 6/1990 |
| EP | 480131 | * | 6/1991 |

* cited by examiner

*Primary Examiner*—Elvin Enad
*Assistant Examiner*—Lisa N Klaus
(74) *Attorney, Agent, or Firm*—Christie, Parker & Hale, LLP

(57) ABSTRACT

A tilt switch includes an insulating housing with a bottom wall surface having an access opening, and an inner peripheral wall surface confining an accommodation chamber for receiving rollably an electrically conductive ball therein. Two electric contact terminals include two contact bodies with two rolling areas that are exposed from the access opening, and two terminal portions extending from the contact bodies and superimposed upon an upper mount surface of a support. The ball is rollable on the rolling areas between a switch-on maintaining position where the ball, though jerked by a slight tilting force, can maintain an electrical connection between the terminals, and a switch-off position where the ball is rolled out of contact with one of the rolling area by a big tilting force.

5 Claims, 10 Drawing Sheets

TILT SWITCH

BACKGROUND OF THE INVENTION

1. Field of the Invention

This invention relates to a tilt switch, more particularly to a tilt switch which is adapted to be mounted on a support and which has an electrically conductive ball that is rollable to establish or break an electrical connection between two electric contact terminals.

2. Description of the Related Art

Referring to FIGS. 1 to 3, a conventional tilt switch 10 is shown to include an insulating housing 11 with an accommodation chamber 114 therein for receiving rollably an electrically conductive ball 14. An insulating plug member 13 is mounted to a lower inner wall 111 of the housing 11. An electrically conductive block 12 is mounted on the plug member 13, and has an elongate terminal 124 extending downwardly through a through hole 133 in the plug member 13. An elongate electric contact terminal 15 extends through a center portion of the plug member 13 and into the accommodation chamber 114 to engage an upper inner wall of the housing 11. The electrically conductive block 12 has an upper downward sloping surface 122 extending downwardly and toward a center portion thereof so as to hold the ball 14 on the sloping surface 122 and in contact with the terminal 15 when the tilt switch 10 stands in an upright position, thereby establishing an electrical connection between the terminals 15,124. Once the tilt switch 10 is tilted, the ball 14 will roll away from the terminal 15 to break the electrical connection. However, the ball 14 is liable to roll out of the upright position even when jerked by a slight tilting force, thereby resulting in undesired interruption of the electrical connection. Moreover, the tilt switch 10 is complicated in construction.

SUMMARY OF THE INVENTION

The object of the present invention is to provide a tilt switch which can maintain an electrical connection between two terminals thereof even when jerked by a slight tilting force.

According to this invention, the tilt switch includes an insulating housing which is adapted to be mounted to be spaced apart from an upper mount surface of a support in an upright direction. The housing includes a bottom wall surface which is adapted to be proximate to the upper mount surface and which has an outer periphery surrounding a centerline that is oriented in the upright direction. A surrounding outer field extends from the outer periphery towards the centerline, and terminates at an inner periphery which defines an access opening with a first dimension and which is adapted to communicate the surrounding outer field with the upper mount surface. An inner peripheral wall surface extends upwardly from the outer periphery, and terminates at an upper surrounding edge. The inner peripheral wall surface confines an accommodation chamber therein.

An electrically conductive ball is received in the accommodation chamber, and is rollable on the surrounding outer field. The ball is of a second dimension that is larger than the first dimension of the access opening so that when the ball rolls into an upright position where the tilt switch is not tilted, a contact surface of the ball protrudes downwardly and outwardly of the access opening.

First and second electric contact terminals are spaced apart from each other in a transverse direction relative to the upright direction. The first electric contact terminal includes a first contact body and a first terminal portion. The second electric contact terminal includes a second contact body and a second terminal portion. Each of the first and second contact bodies includes a lower major wall surface which is adapted to be electrically insulated from the upper mount surface, and an upper major wall surface opposite to lower major wall surface in the upright direction. The upper major wall surface includes a rolling area. The rolling areas of the first and second contact bodies are electrically insulated from each other, and are configured such that, when the upper major wall surfaces of the first and second contact bodies are brought to be disposed under the bottom wall surface, the rolling areas of the first and second contact bodies are exposed from the access opening, and such that, in the upright position, the ball is in contact with the rolling areas to establish an electrical connection between the first and second contact bodies. The contact surface of the ball is rollable on the rolling areas between a switch-on maintaining position, where the contact surface of the ball can still contact the rolling areas of both the first and second contact bodies even when the ball is jerked by a slight tilting to roll out of the upright position, thereby maintaining the electrical connection by virtue of bridging the first and second contact bodies, and a switch-off position, where the contact surface of the ball is thrown out of contact with at least one of the rolling areas by a large tilting force. Each of the first and second terminal portions includes a proximate end connected to a respective one of the first and second contact bodies, and a distal end extending from the proximate end in a plane to which the centerline is normal. The distal end is adapted to be superimposed on the upper mount surface of the support, thereby making an electric contact therebetween.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
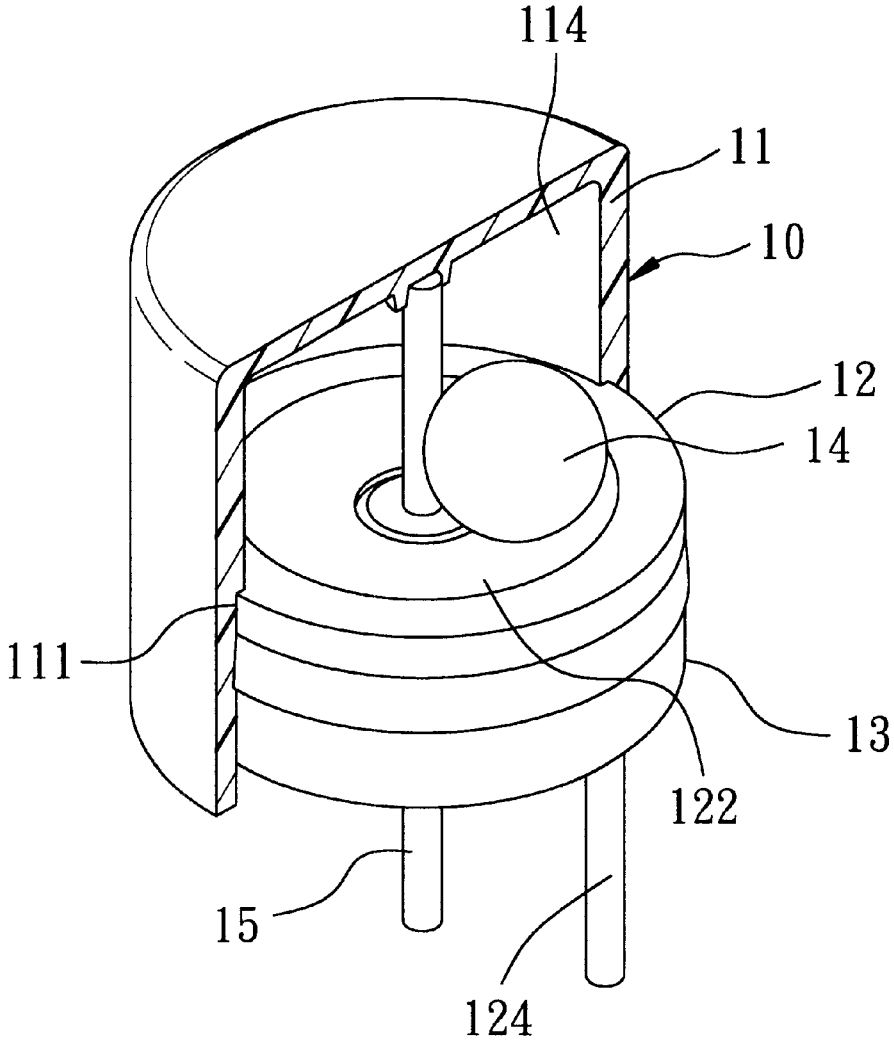
FIG. 1 PRIOR ART
FIG. 1 is a fragmentary perspective view of a conventional tilt switch.
Figure 2:
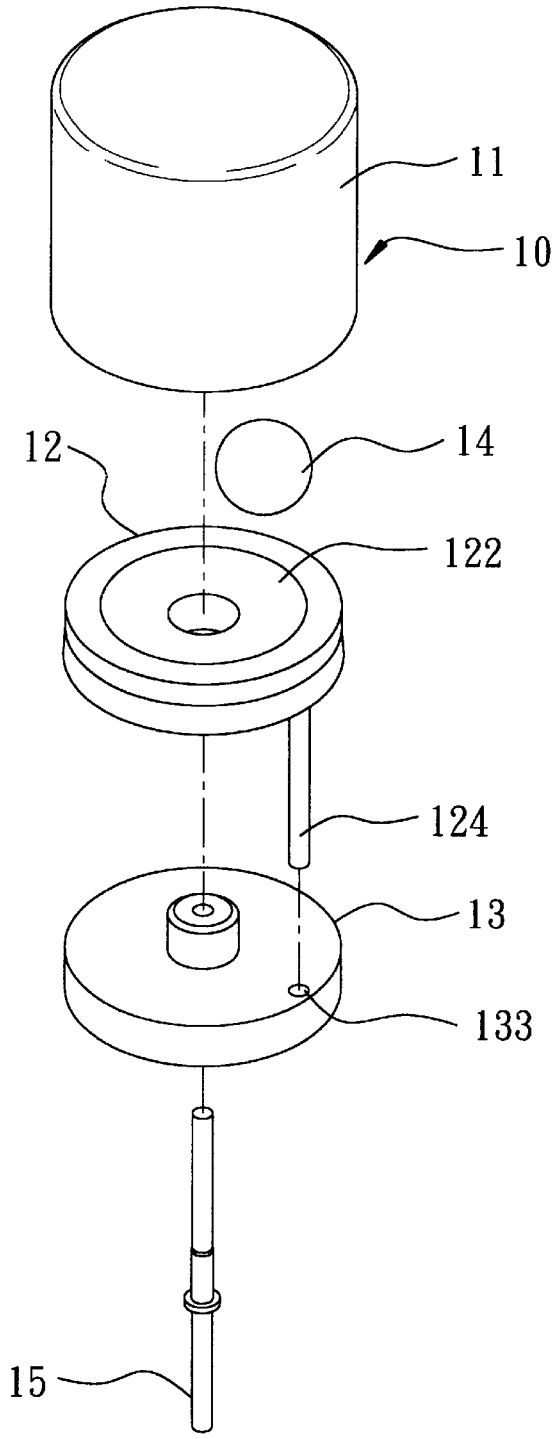
FIG. 2 PRIOR ART
FIG. 2 is an exploded perspective view of the conventional tilt switch.
Figure 3:
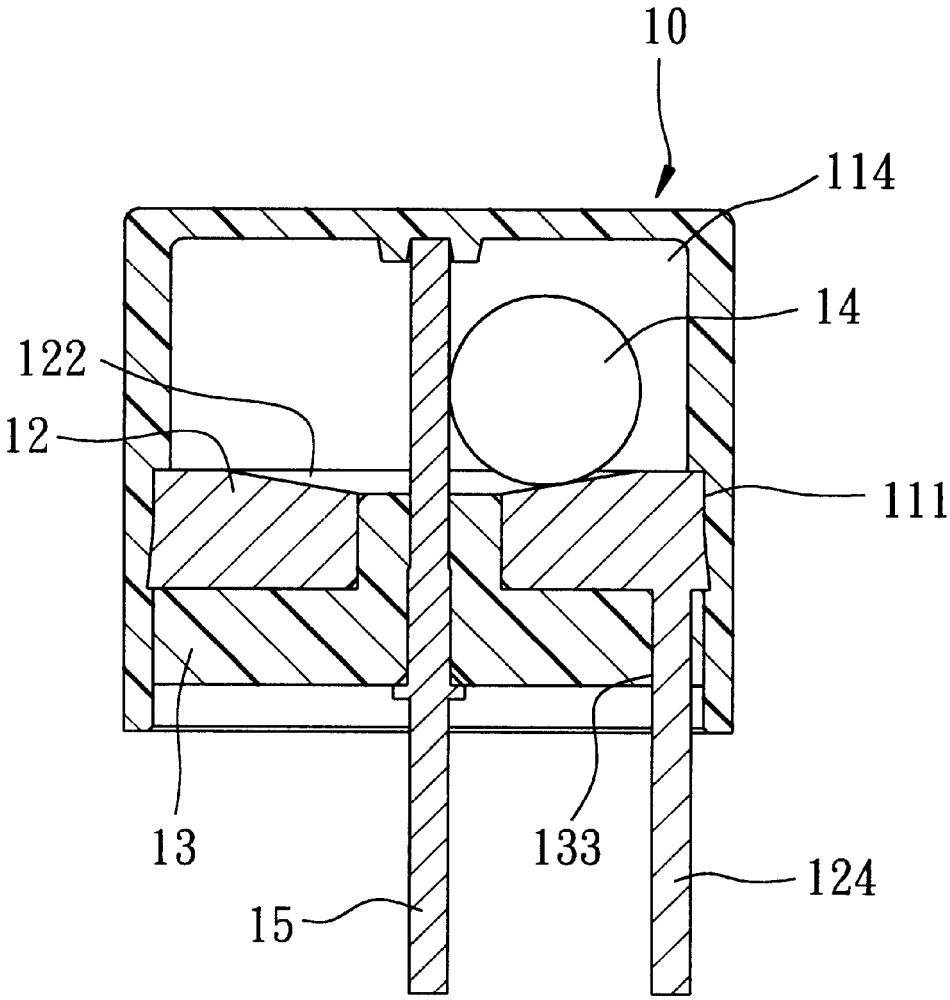
FIG. 3 PRIOR ART
FIG. 3 is a longitudinally sectional view of the conventional tilt switch.
Figure 4:
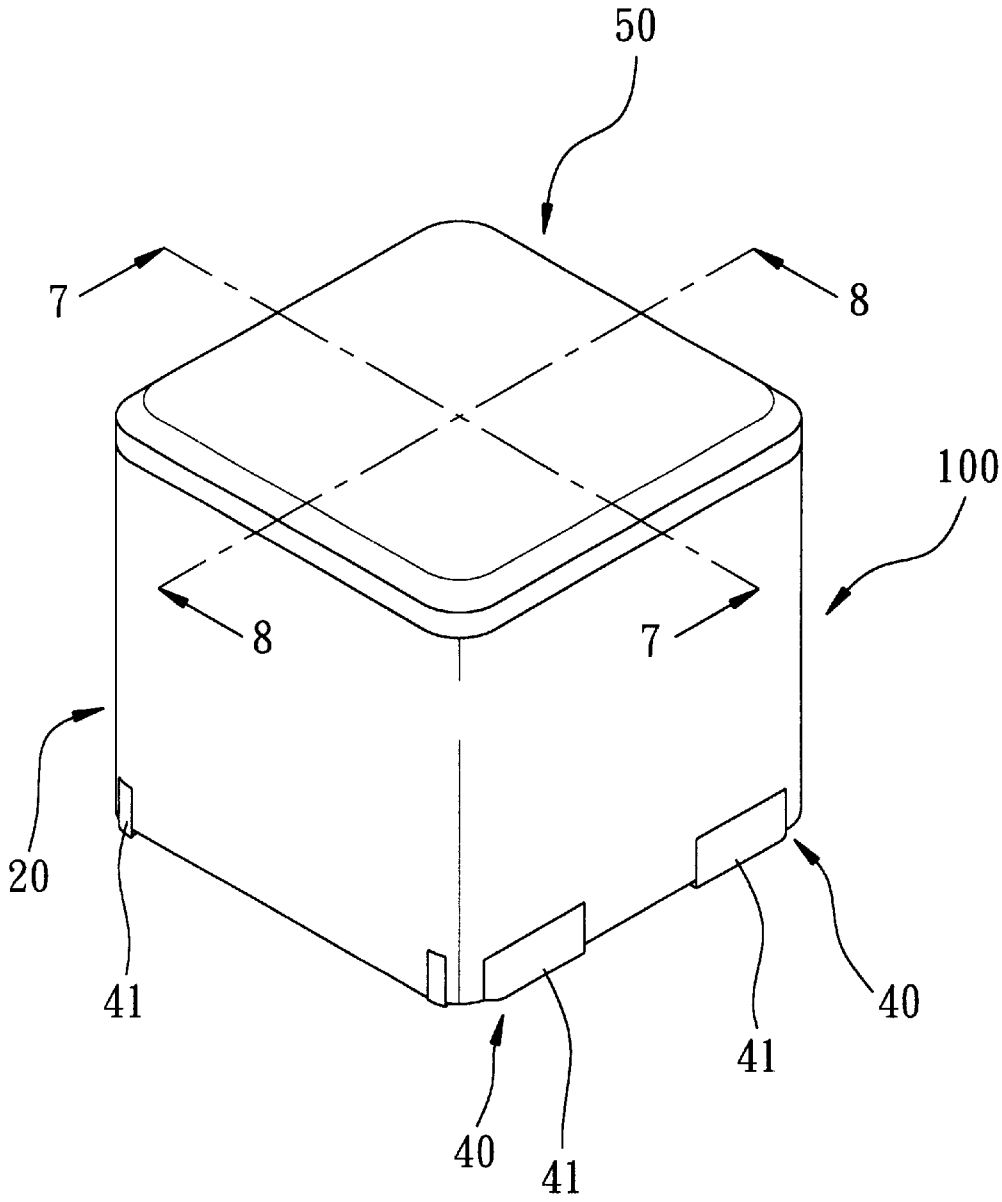
FIG. 4 is a perspective view of a preferred embodiment of a tilt switch according to this invention.
Figure 5:
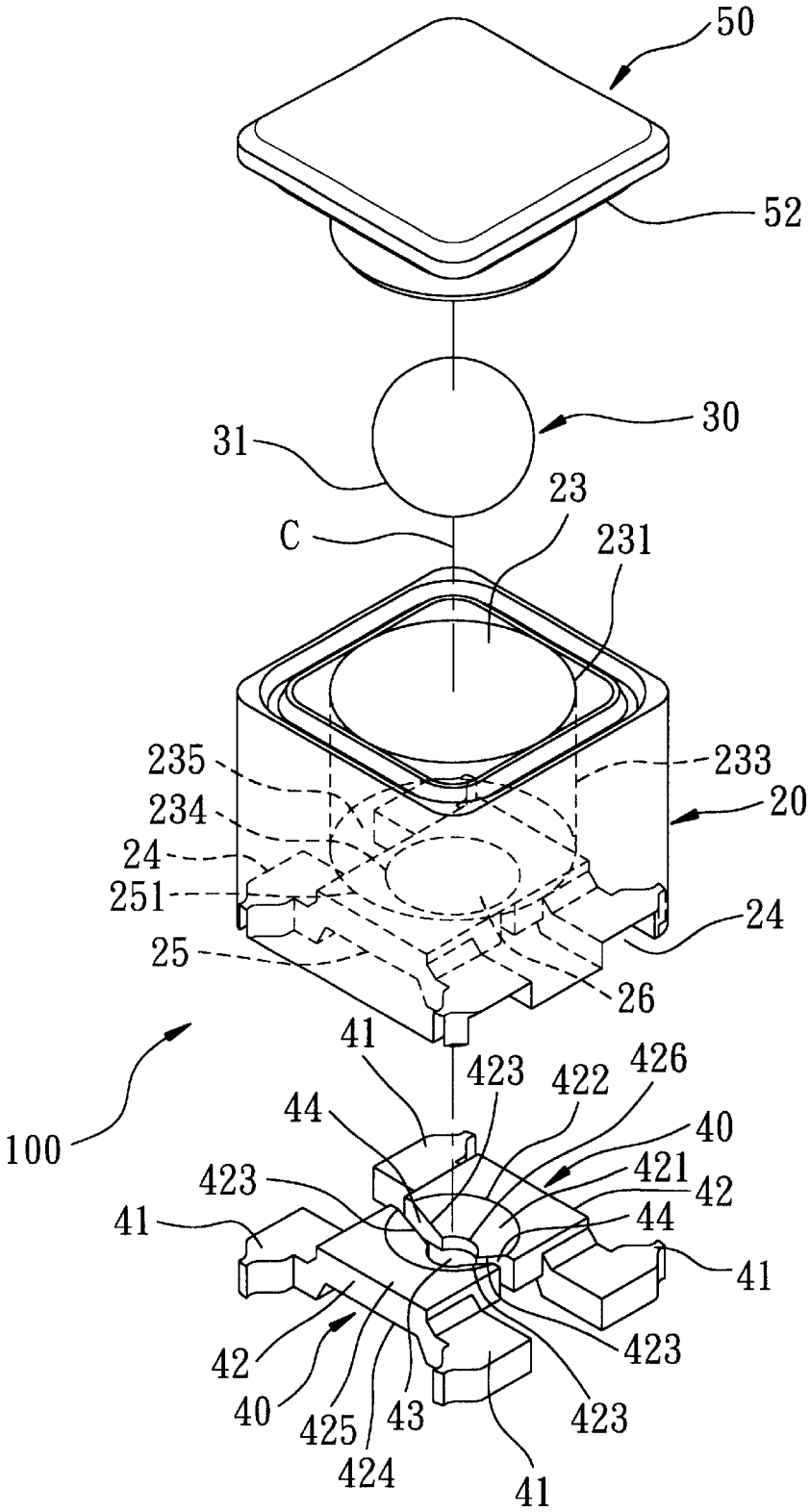
FIG. 5 is an exploded perspective view of the preferred embodiment.
Figure 6:
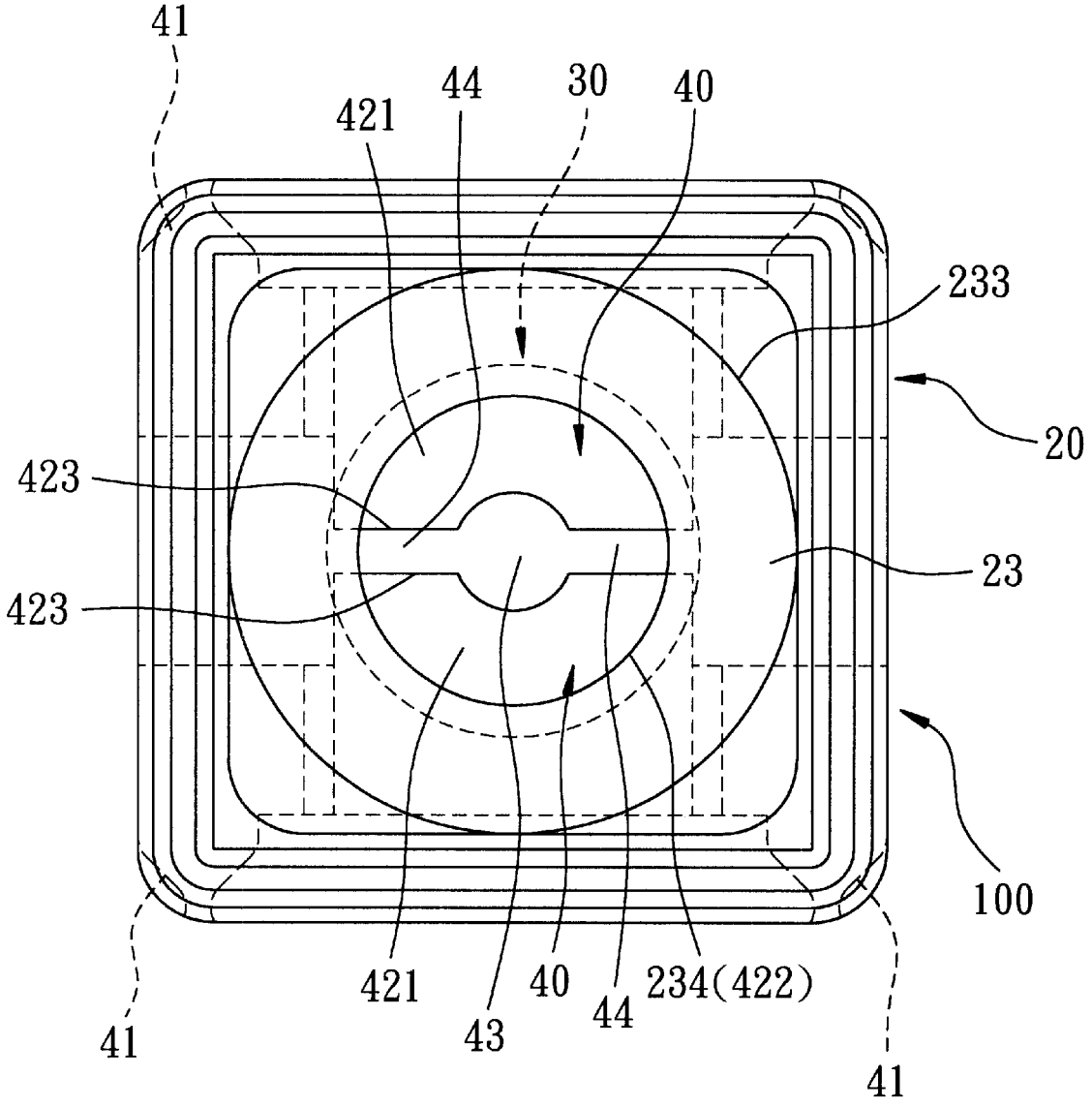
FIG. 6 is a schematic bottom view of the preferred embodiment.
Figure 7:
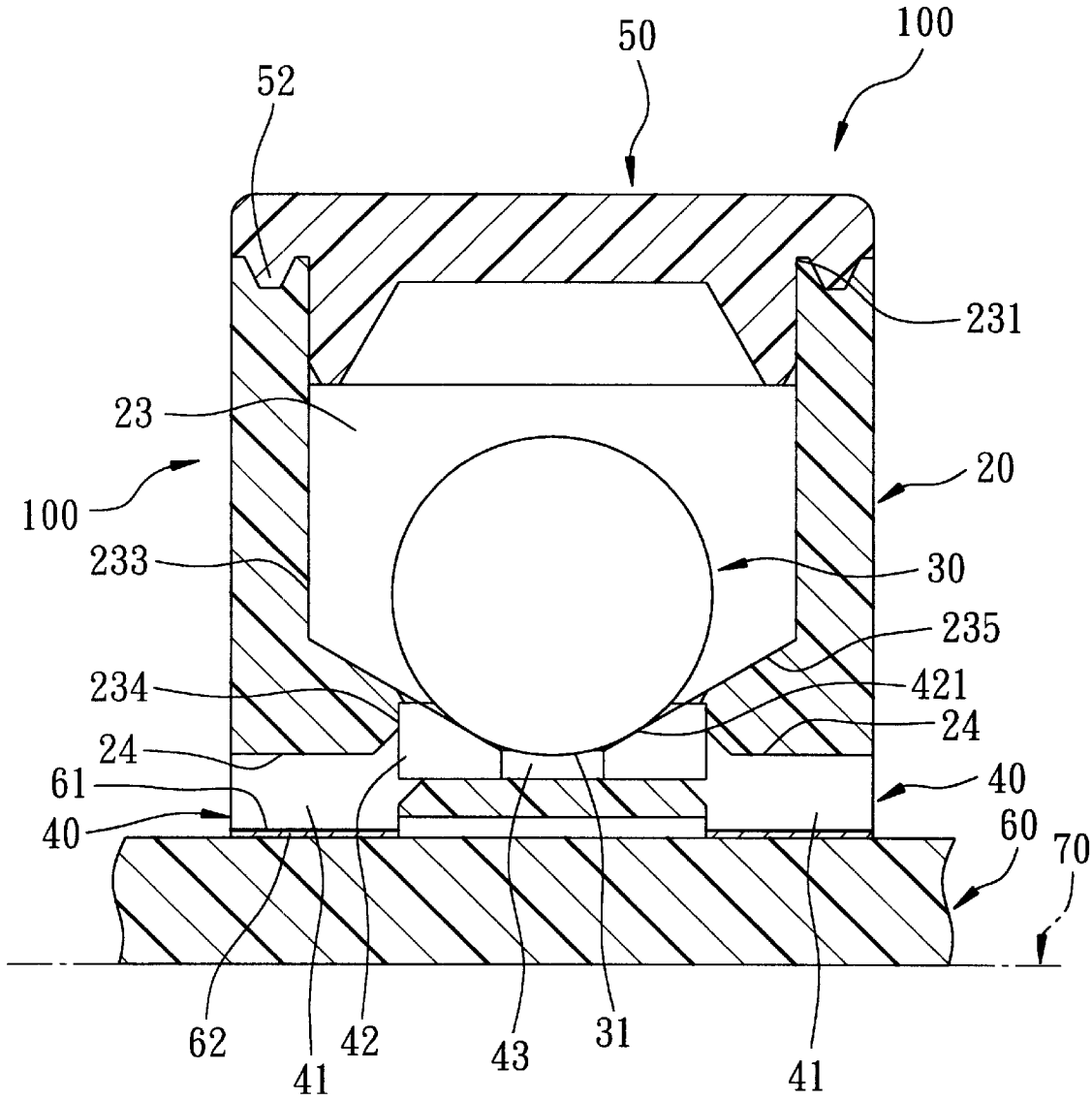
FIG. 7 is a sectional view of the tilt switch of the preferred embodiment in an upright state, taken along lines 7—7 in FIG. 4.

Referring to FIGS. 4, 5 and 7, the preferred embodiment of a tilt switch 100 according to the present invention is shown to comprise a rectangular insulating housing 20, an electrically conductive ball 30, first and second electric contact terminals 40, and an insulating cap member 50.

The housing 20 is adapted to be mounted to be spaced apart from an upper mount surface 61 of a support 60, such as a circuit board, in an upright direction. The housing 20 includes a bottom wall surface 25 adapted to be proximate to the upper mount surface 61 of the support 60. The bottom wall surface 25 has an outer periphery 251 which surrounds a centerline (C) that is oriented in the upright direction, and a surrounding outer field 235 which extends from the outer periphery 251 towards the centerline (C) and which terminates at an inner periphery 234 that defines an access opening 26 with a first diameter so as to communicate the surrounding outer field 235 with the upper mount surface 61 of the support 60. An inner peripheral wall surface 233 extends upwardly from the outer periphery 251, and terminates at an upper surrounding edge 231. The inner peripheral wall surface 233 confines an accommodation chamber 23 therein. Two pairs of mounting recesses 24 are integrally formed with the bottom wall surface 25 and face downwardly.

The conductive ball 30 is made of a metal material, such as copper and steel, and is received in the accommodation chamber 23. The ball 30 is rollable on the surrounding outer field 235, and has a second diameter that is larger than the first diameter of the access opening 26 such that when the ball 30 rolls into an upright position as shown in FIG. 7, where the tilt switch 100 is not tilted, a contact surface 31 of the ball 30 protrudes downwardly and outwardly of the access opening 26.

The first and second electric contact terminals 40 are disposed to be spaced apart from each other in a transverse direction relative to the upright direction. The first electric contact terminal 40 includes a first contact body 42 and two first terminal portions 41. The second electric contact terminal 40 includes a second contact body 42 and two second terminal portion 41.

Each of the first and second contact bodies 42 includes a lower major wall surface 424 which is adapted to be electrically insulated from the upper mount surface 61 of the support 60, and an upper major wall surface 425 opposite to lower major wall surface 424 in the upright direction. The upper major wall surfaces 425 of the first and second contact bodies 42 are disposed under the bottom wall surface 25 of the housing 20. The upper major wall surface 425 has a substantially semicircular upper edge 422 and a downward sloping surface portion 421 which extends from the upper edge 422 downwardly and towards the centerline (C) and which terminates at a substantially semicircular lower edge 426. The downward sloping surface portions 421 are spaced apart from each other in a transverse direction relative to the upright direction, and respectively form rolling areas 421. Each rolling areas 421 has substantially circular upper and lower boundaries at the upper and lower edges 422,426, respectively. Moreover, the lower edges 426 of the rolling areas 421 cooperatively define a seat portion 43 so as to hold the ball 30 in the upright direction. As such, the ball 30 is in contact with the rolling areas 421 to establish an electrical connection between the first and second contact bodies 42.

In addition, the downward sloping surface portion 421 of each of the first and second contact bodies 42 extends angularly about the centerline (C) and terminates at two lateral edges 423. Each adjacent pair of the lateral edges 423 of the downward sloping surface portions 421 confront and are spaced apart from each other in the transverse direction by a clearance 44.

The first and second terminal portions 41 are press-fitted in the mounting recesses 24, respectively. Each of the first and second terminal portions 41 includes a proximate end integrally connected to a respective one of the first and second contact bodies 42, and a distal end extending from the proximate end in a plane to which the centerline (C) is normal and adapted to be superimposed on a copper foil 62 mounted on the upper mount surface 61 of the support 60, thereby making an electric contact between the respective one of the first and second electric contact terminals 40 and the support 60.

The insulating cap member 50 includes a peripheral edge portion 52 which is disposed sealingly on the upper surrounding edge 231 of the housing 20 to cover the accommodation chamber 23.

Figure 8:
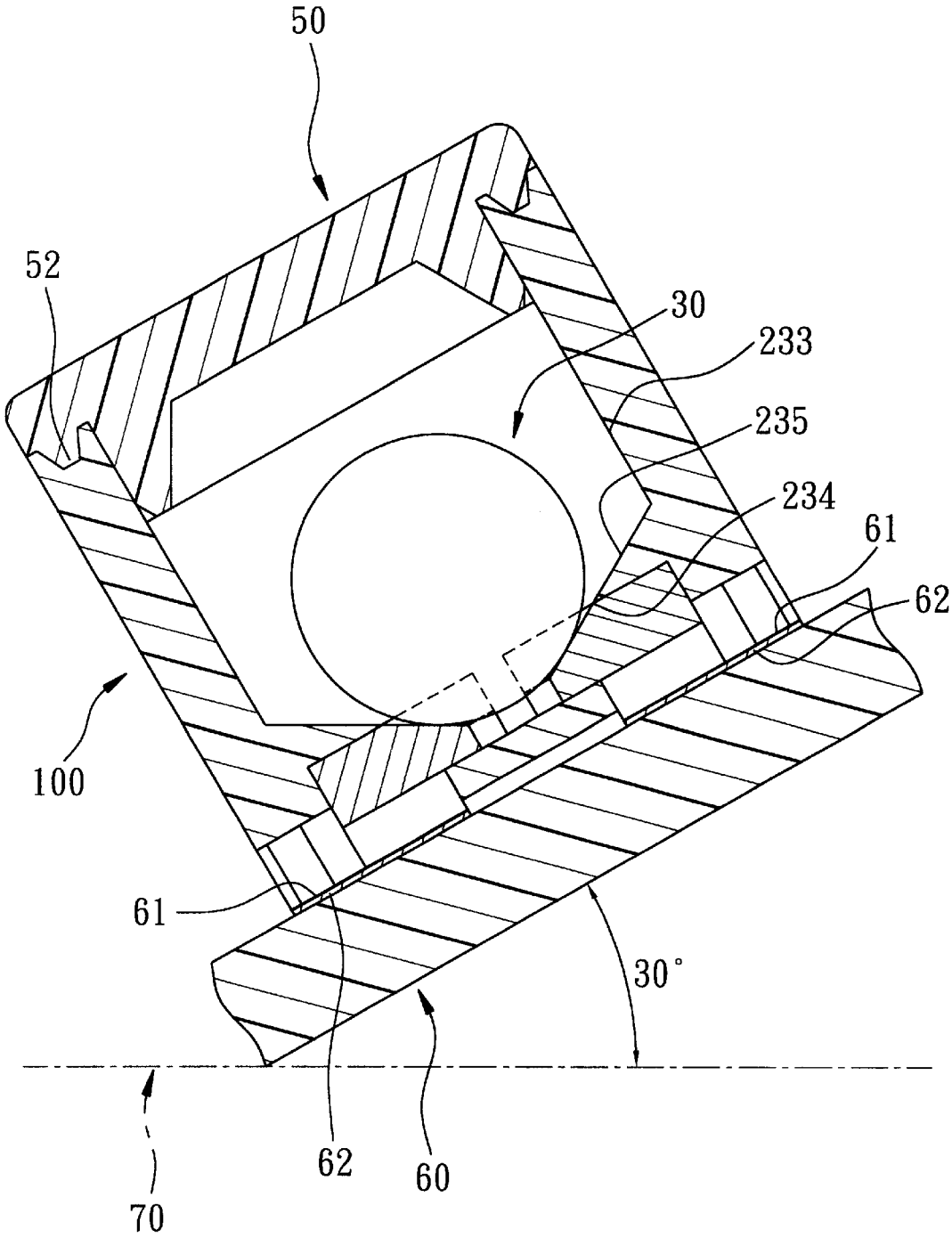
FIG. 8 is a sectional view of the tilt switch of the preferred embodiment in a switch-on maintaining state when tilted slightly, taken along lines 8—8 in FIG. 4.
Figure 10:
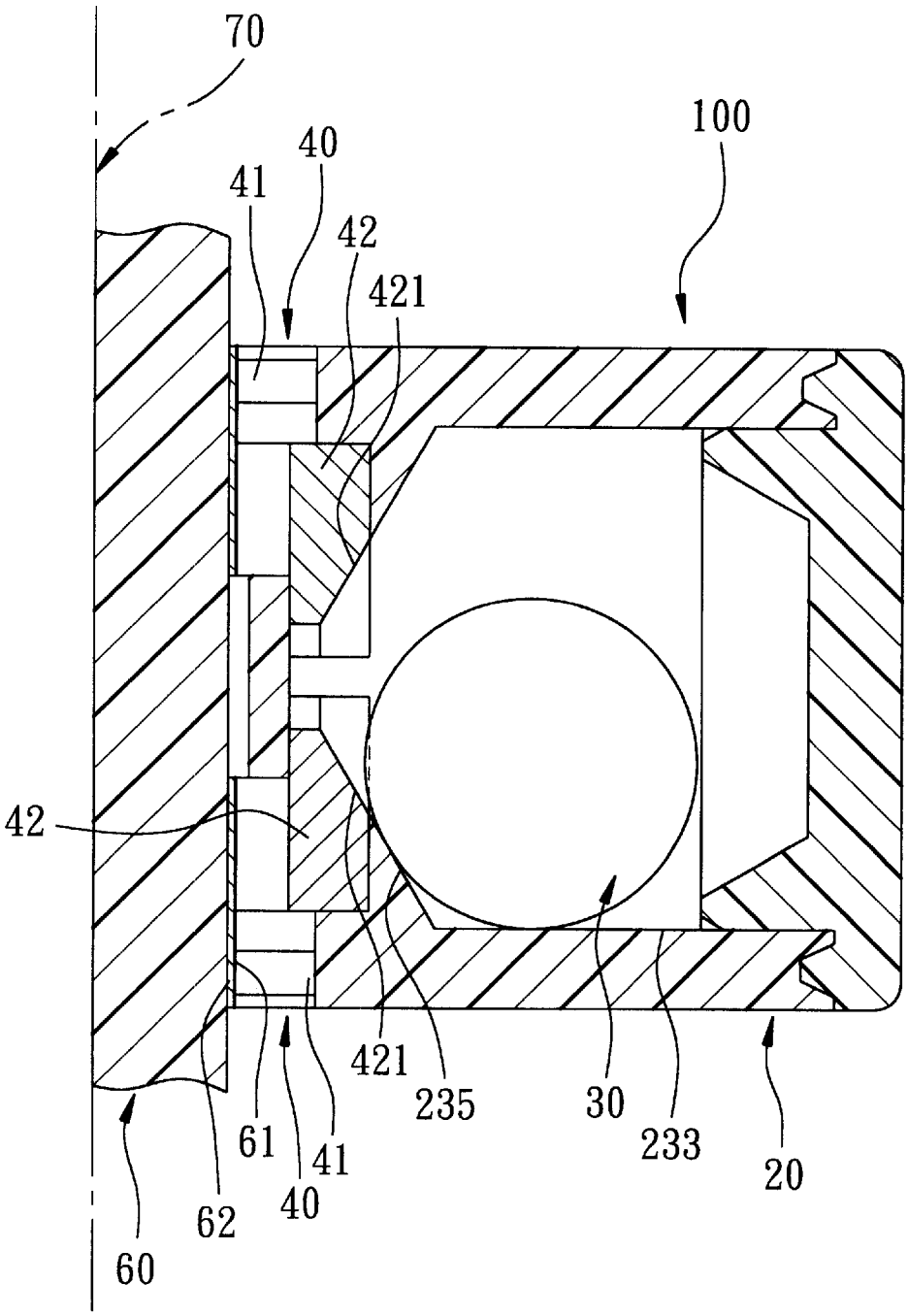
FIG. 10 is a sectional view similar to FIG. 7, showing the tilt switch of the preferred embodiment in a switch-off state.

In assembly, the upper major wall surfaces 425 of the first and second contact bodies 42 are disposed under the bottom wall surface 25 of the housing 20 such that the rolling areas 421 are exposed from the access opening 26, and such that the upper edges 422 of the first and second contact bodies 42 are flush with the inner periphery 234 of the bottom wall surface 25 of the housing 20. Thus, the ball 30 is rollable on the rolling areas 421 between a switch-on maintaining position, as shown in FIG. 8, and a switch-off position, as shown in FIG. 10. In the switch-on maintaining position, where the contact surface 31 of the conductive ball 30, though the support 60 and thus the tilt switch 100 are jerked by a slight tilting so as to be tilted at a small angle of 30 degrees for instance, relative to a horizontal plane 70, the contact surface 31 of the ball 30 can still contact the rolling areas 421 of both the first and second contact bodies 42, thereby maintaining the electrical connection between the first and second contact bodies 42.

Figure 9:
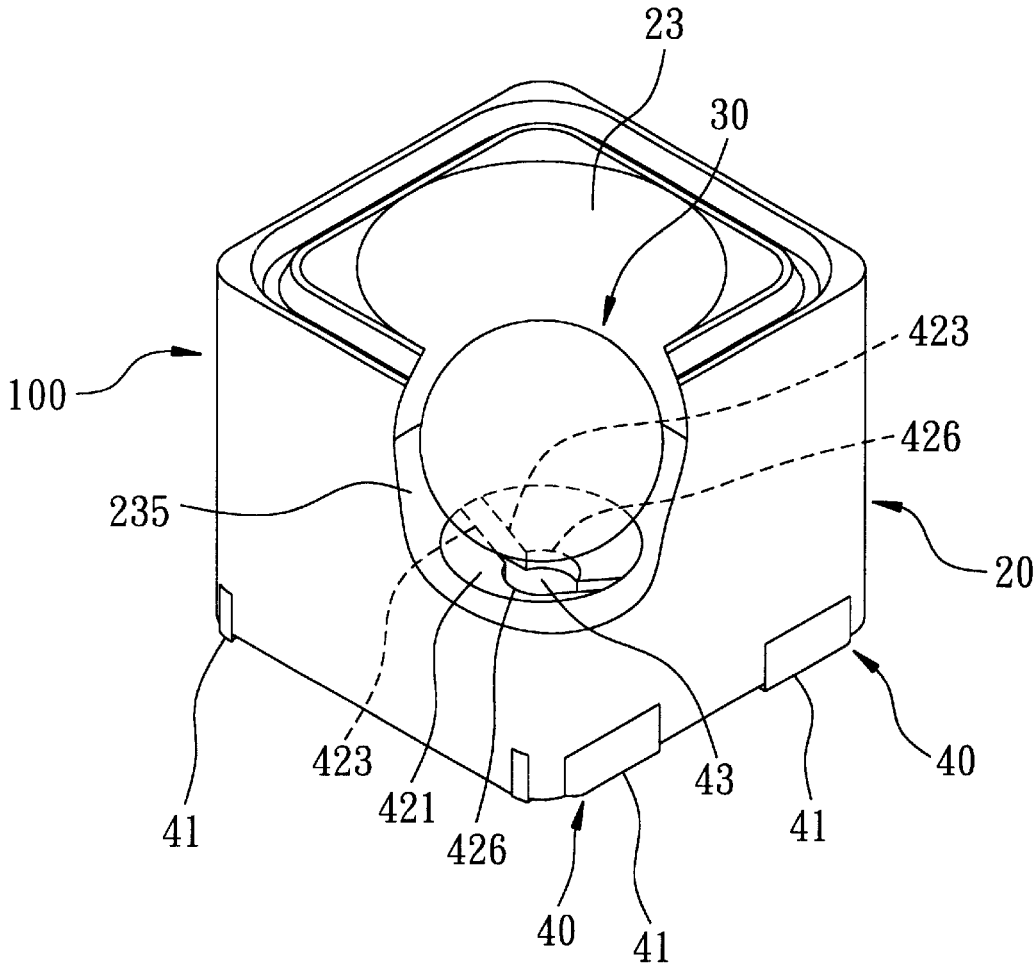
FIG. 9 is a fragmentary perspective view of the preferred embodiment, a cap member thereof being removed for the sake of clarity.

Specifically, referring to FIG. 9, when the tilted switch 100 is subjected to a slight vibration so that the ball 30 rolls away from the seat portion 43, the contact surface 31 can still contact the lateral edges 423 of the downward sloping surface 421 to thereby maintain the electrical connection between the first and second contact bodies 42.

Referring to FIG. 10, when the support 60 is subjected to a large tilting force and the tilt switch 100 is tilted by 90 degrees for instance, relative to the horizontal plane 70, the ball 30 rolls to the switch-off position, where the contact surface 31 of the ball 30 is thrown out of contact with at least one of the rolling areas 421, thereby breaking the electrical connection between the first and second contact bodies 42.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A tilt switch mounted on and to be in electric contact with an upper mount surface of a support by virtue of a direct surface-to-surface abutment, said tilt switch comprising:

an insulating housing mounted to be spaced apart from the upper mount surface of the support in an upright direction, and including a bottom wall surface adapted to be proximate to the upper mount surface, and having an outer periphery surrounding a centerline which is oriented in the upright direction, and a surrounding outer field which extends from said outer periphery towards the centerline and which terminates at an inner periphery that defines an access opening with a first dimension and that is adapted to communicate said surrounding outer field with the upper mount surface, and an inner peripheral wall surface extending upwardly from said outer periphery, and terminating at an upper surrounding edge, said inner peripheral wall surface confining an accommodation chamber therein;

an electrically conductive ball received in said accommodation chamber, and rollable on said surrounding outer field, said ball being of a second dimension that is larger than said first dimension of said access opening such that when said conductive ball rolls into an upright position where the tilt switch is not tilted, a contact surface of said ball protrudes downwardly and outwardly of said access opening; and first and second electric contact terminals disposed to be spaced apart from each other in a transverse direction relative to the upright direction, said first electric contact terminal including a first contact body and a first terminal portion, said second electric contact terminal including a second contact body and a second terminal portion, each of said first and second contact bodies including a lower major wall surface electrically insulated from the upper mount surface, and an upper major wall surface.opposite to said lower major wall surface in the upright direction, and including a rolling area, said rolling areas of said first and second contact bodies being electrically insulated from each other, and being configured such that, when said upper major wall surfaces of said first and second contact bodies are brought to be disposed under said bottom wall surface, said rolling areas of said first and second contact bodies are exposed from said access opening, and such that, when said ball is in the upright direction, said contact surface of said ball is in contact with said rolling areas to establish an electrical connection between said first and second contact bodies, said contact surface of said ball being rollable on said rolling areas between a switch-on maintaining position, where said contact surface of said ball can still contact both said rolling areas of said first and second contact bodies when said ball is jerked by a slight tilting force to roll out of the upright position, thereby maintaining the electrical connection by virtue of bridging said first and second contact bodies, and a switch-off position, where said contact surface of said ball is thrown out of contact with at least one of said rolling areas by a large tilting force, each of said first and second terminal portions including a proximate end connected to a respective one of said first and second contact bodies, and a distal end extending from said proximate end in a plane to which the centerline is normal, and superimposed on the upper mount surface of the support thereby making an electric contact therebetween.

2. The tilt switch of claim 1, wherein said upper major wall surfaces of said first and second contact bodies respectively have substantially semicircular upper edges which cooperatively define a substantially circular upper boundary of said rolling areas, and downward sloping surface portions which respectively extend from said upper edges downwardly and towards the centerline and which respectively terminate at substantially semicircular lower edges, said lower edges being spaced apart from each other in the transverse direction and cooperatively defining a substantially circular lower boundary of said rolling areas.

3. The tilt switch of claim 2, wherein said upper edges of said contact areas are disposed to be flush with said inner periphery of said bottom wall surface of said housing.

4. The tilt switch of claim 2, wherein said housing further includes two mounting recesses which are integrally formed with said bottom wall surface, which face downwardly, said mounting recesses being configured such that said first and second terminal portions can be press-fitted into said mounting recesses when said first and second electric contact terminals are mounted to said housing.

5. The tilt switch of claim 1, further comprising an insulating cap member with a peripheral edge portion which is disposed sealingly on said upper surrounding edge of said housing.

* * * * *